US008720142B2

(12) United States Patent
Spilchen

(10) Patent No.: US 8,720,142 B2
(45) Date of Patent: May 13, 2014

(54) STABILIZED LATH AND METHOD OF MANUFACTURE

(75) Inventor: William Spilchen, White Rock (CA)

(73) Assignee: Sacks Industrial Corporation, Vancouver (CA)

( * ) Notice: Subject to any disclaimer, the term of this patent is extended or adjusted under 35 U.S.C. 154(b) by 0 days.

(21) Appl. No.: 13/592,784

(22) Filed: Aug. 23, 2012

(65) Prior Publication Data

US 2014/0053495 A1 Feb. 27, 2014

(51) Int. Cl.
*E04F 13/04* (2006.01)

(52) U.S. Cl.
USPC ..... 52/343; 52/664

(58) Field of Classification Search
USPC ..... 52/660–665, 342–344, 361–363, 648.1, 52/649.1, 565, 562, 432, 677, 649.8, 513, 52/687, 383, 714, 379, 649.6
See application file for complete search history.

(56) References Cited

U.S. PATENT DOCUMENTS

| | | | | | |
|---|---|---|---|---|---|
| 320,163 | A | | 6/1885 | Orr | |
| 528,931 | A | | 11/1894 | Eils | |
| 617,458 | A | * | 1/1899 | Clancy | 52/660 |
| 659,416 | A | * | 10/1900 | Perry | 52/669 |
| 1,769,361 | A | | 7/1930 | Warren | |
| 2,022,363 | A | * | 11/1935 | Vertuno | 52/386 |
| 2,375,303 | A | | 5/1945 | Karelius | |
| 2,903,880 | A | | 9/1959 | Johnson | |
| 3,145,001 | A | | 8/1964 | Bruninga | |
| 3,342,003 | A | * | 9/1967 | Frank | 52/664 |
| 3,660,215 | A | * | 5/1972 | Pawlicki | 428/593 |
| 3,672,022 | A | * | 6/1972 | York | 428/593 |
| 3,991,536 | A | * | 11/1976 | Rutherford | 52/661 |
| 4,539,787 | A | * | 9/1985 | Ritter et al. | 52/664 |
| 5,540,023 | A | | 7/1996 | Jaenson | |
| 6,363,679 | B1 | | 4/2002 | Rutherford | |
| 6,820,387 | B2 | | 11/2004 | Sacks et al. | |
| 7,287,356 | B2 | * | 10/2007 | Sacks et al. | 52/343 |
| 2005/0055953 | A1 | * | 3/2005 | Sacks et al. | 52/633 |
| 2007/0119106 | A1 | * | 5/2007 | Sacks et al. | 52/255 |
| 2007/0175145 | A1 | * | 8/2007 | Sacks et al. | 52/408 |

* cited by examiner

*Primary Examiner* — Brian Glessner
*Assistant Examiner* — Beth Stephan
(74) *Attorney, Agent, or Firm* — Seed IP Law Group PLLC

(57) ABSTRACT

A lath and method to produce a lath may include furring strand wires with furring bends, transverse wires joined to the furring strand wires to not overlap a furring bend, and a stabilization wire arranged along a serpentine path and joined to the transverse wires.

23 Claims, 4 Drawing Sheets

STABILIZED LATH AND METHOD OF MANUFACTURE

BACKGROUND

1. Technical Field

The present disclosure relates to laths.

2. Description of the Related Art

It is generally desirable to apply a material, such as a cladding, on to a surface, such as a substrate. A cladding may be applied for various reasons, including substrate protection and ornamental design. Stucco plaster is a common cladding utilized in construction. Stucco plaster may be applied directly to a substrate, or a lath may be utilized. A lath is generally mounted to a substrate before stucco plaster is applied.

A lath generally provides structural support for stucco plaster. Structural support is achieved when stucco plaster is "keyed" to a lath, which generally means that sufficient stucco plaster is applied around a lath. In order to have sufficient keying of stucco plaster around a lath, portions of a lath are spaced away from a substrate.

A lath may be made from various materials, for instance welded wire, and may have various forms, including a grid shape. Because it is desirable to space portions of a lath away from a substrate in order to have sufficient keying, self-furring laths were developed. A self-furring welded-wire lath generally has a series of furrs or crimps formed into the lath, which may for example be one quarter inch in depth. Furrs may be roll formed or stamped into the lath after the lath is formed. Both roll forming and stamping of furrs cause shrinkage of a distance between two end points of a wire of a welded-wire lath. So that a lath remains relatively flat, rows of furrs are formed in about the same position on each parallel wire of a lath so that there is generally uniform shrinkage of every parallel wire.

The furring portions of a self-furring lath generally rest against a substrate so that the remaining portions of the self-furring lath are spaced away from the substrate. Furthermore, fasteners, such as nails, screws, bolts, staples, pins or the like, are generally utilized to attach the lath to the substrate. Accordingly, the portions of the lath spaced away from the substrate may be sufficiently keyed when stucco plaster is applied. However, seismic events or fatigue of a structure may cause a fastener to become de-attached from the lath, or may cause breaking of a weld or a lath wire. Furthermore, such detachment or breakage may cause stucco plaster to crack.

BRIEF SUMMARY

The Applicants have observed that rows of furrs formed in about the same position on each parallel wire of a lath cause a structural weakness in the lath. Applicants have also observed that a furr or crimp tends to be the weakest part of a welded wire lath, subjecting such to failure under cycle loading conditions such as those experienced during seismic events. The Applicants believe that rows of furrs can act as a series of expansion loops, and consequently, applied stucco plaster is prone to cracking in the vicinity of a furr. Accordingly, the Applicants have improved a lath so that the stability, strength and reinforcement of the lath is increased.

Furthermore, Applicants have observed that conventional laths have weaknesses that may be revealed by seismic events. Accordingly, Applicants have improved a lath to include a stabilization elongate member that Applicants discovered to act as a stabilizing tie allowing for drift between the substrate and lath, resistance to de-attachment of fasteners and resistance to breaking of lath wires and welds. Consequently, Applicants have improved a lath such that stucco plaster is less susceptible to cracking due to seismic movement.

A lath may be summarized as including a plurality of furring strand elongate members, the furring strand elongate members at least approximately parallel to and spaced apart from one another, each of the furring strand elongate members have at least one furring bend; a plurality of transverse elongate members, each of the transverse elongate members physically joined to at least one of the furring strand elongate members, the transverse elongate members at least approximately parallel to and spaced apart from one another, and the transverse elongate members at least approximately perpendicular to the furring strand elongate members; and a stabilization elongate member that has a serpentine path and that at least a portion of which extends between a first outermost and a second outermost ones of the transverse elongate members and between a first outermost and a second outermost ones of the furring strand elongate members, the stabilization elongate member having a first plurality of straight portions that are at least approximately parallel to the furring strand elongate members and a second plurality of portions that are at least approximately parallel to the transverse elongate members, the stabilization elongate member physically joined to a number of at least one of the transverse elongate members or at least one of the furring strand elongate members or combinations thereof. The stabilization elongate member may not extend beyond the first outermost or the second outermost ones of the transverse elongate members.

A first number of the second plurality of straight portions of the stabilization elongate member may be spaced from a first inward transverse elongate member by a distance sized to receive a fastener therebetween and a second number of the second plurality of straight portions of the stabilization elongate member may be spaced from a second inward traverse elongate member by a distance sized to receive a fastener therebetween, the first inward transverse elongated member being the most immediately adjacent transverse member to the first outermost transverse elongated member and the second inward transverse elongated member being the most immediately adjacent transverse member to the second outermost transverse elongated member. The stabilization elongate member may extend beyond the first outermost and the second outermost ones of the furring strand elongate members. The transverse elongate members and the stabilization elongate member substantially may lie in a single plane. The furring may bend extend substantially perpendicularly to the single plane. The furring strand elongate members may be substantially straight except for the furring bends, and the furring bends may be at least one of U-shaped, V-shaped or flat-bottom-channel projections in the otherwise straight furring strand elongate members. For each of a number of successive pairs of furring strand elongate members, there may be a respective one of the first plurality of straight portions of the stabilization elongate member extending therebetween. For each of a number of pairs of the furring strand elongate members, there may be a respective one of the first plurality of straight portions of the stabilization elongate member extending between one of the furring strand elongate members of the pair and one of the furring strand elongated members of a next successively adjacent pair of the furring strand elongated members. Each elongate member may comprise wire and a diameter of the stabilization elongate member may be less than a corresponding diameter of the furring strand elongate members. The stabilization elongate member may be physically joined to the number of at least one of the furring strand elongated members or at least one of the stabilization elongated members or combinations thereof via at least one respective weld. Each of the transverse elongate members may be physically joined to at least one of the furring strand elongate members at a location along the at least one furring strand elongate member that does not overlap with any of the at least one furring bends of the respective at least one furring strand elongate member.

A method of producing a lath may be summarized as including arranging a plurality of furring strand elongate members, the furring strand elongate members at least approximately parallel to and spaced apart from one another, each of the furring strand elongate members have at least one furring bend; arranging a plurality of transverse elongate members, the transverse elongate members at least approximately parallel to and spaced apart from one another, and the transverse elongate members at least approximately perpendicular to the furring strand elongate members; arranging a stabilization elongate member to have a serpentine path such that at least a portion of which extends between a first outermost and a second outermost ones of the transverse elongate members and between a first outermost and a second outermost ones of the furring strand elongate members, arranging the stabilization elongate member to have a first plurality of straight portions that are at least approximately parallel to the furring strand elongate members and a second plurality of portions that are at least approximately parallel to the transverse elongate members; physically joining each of the transverse elongate members to at least one of the furring strand elongate members; and physically joining the stabilization elongate member to a number of at least one of the transverse elongate members or at least one of the furring strand elongate members or combinations thereof. The arranging of the stabilization elongate member may comprise arranging the stabilization elongate member to not extend beyond the first outermost or the second outermost ones of the transverse elongate members.

The arranging of the stabilization elongate member may comprise spacing a first number of the second plurality of straight portions of the stabilization elongate member from a first inward transverse elongate member by a distance sized to receive a fastener therebetween and spacing a second number of the second plurality of straight portions of the stabilization elongate member from a second inward traverse elongate member by a distance sized to receive a fastener therebetween, the first inward transverse elongated member being the most immediately adjacent transverse member to the first outermost transverse elongated member and the second inward transverse elongated member being the most immediately adjacent transverse member to the second outermost transverse elongated member. The arranging of the stabilization elongate member may comprise arranging the stabilization elongate member to extend beyond the first outermost and the second outermost ones of the furring strand elongate members. The arranging of the plurality of transverse elongate members and the arranging of the stabilization elongate member may comprise arranging the plurality of transverse elongate members and arranging the stabilization elongate member to lie in a single plane. The arranging of the plurality of furring strand elongate members may comprise arranging the furring bends of the plurality of furring strand elongate members to extend substantially perpendicularly to the single plane.

The method may further include forming the furring strand elongate members to be substantially straight except for the furring bends; and forming the furring bends to be at least one of U-shaped, V-shaped or flat-bottom-channel projections in the otherwise straight furring strand elongate members. The arranging of the stabilization elongate member may comprise, for each of a number of successive pairs of furring strand elongate members, arranging a respective one of the first plurality of straight portions of the stabilization elongate member to extend therebetween. The arranging of the stabilization elongate member may comprise, for each of a number of pairs of the furring strand elongate members, arranging a respective one of the first plurality of straight portions of the stabilization elongate member to extend between one of the furring strand elongate members of the pair and one of the furring strand elongated members of a next successively adjacent pair of the furring strand elongated members.

The method may further include forming each elongate member to comprise wire; and forming a diameter of the stabilization elongate member to be less than a corresponding diameter of the furring strand elongate members. The physically joining the stabilization elongate member to the number of at least one of the transverse elongate members or at least one of the furring strand elongate members or combinations thereof may be via at least one respective weld. The physically joining of each of the transverse elongate members to at least one of the furring strand elongate members may be at a location along the at least one furring strand elongate member that does not overlap with any of the at least one furring bends of the respective at least one furring strand elongate member.

BRIEF DESCRIPTION OF THE SEVERAL VIEWS OF THE DRAWINGS

In the drawings, identical reference numbers identify similar elements. For clarity of illustration, similar elements within a figure may only be called out for a representative element of similar elements. Of course, any number of similar elements may be included in a lath, and the number of similar elements shown in a drawing is intended to be illustrative, not limiting. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

FIG. 4 is a cross sectional, right side isometric view of the lath of

FIG. 1.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with laths such as substrates, fasteners for mounting laths to substrates, barrier layers separating stucco plaster from substrates, methods for mounting laths, etc., have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Figure 1:
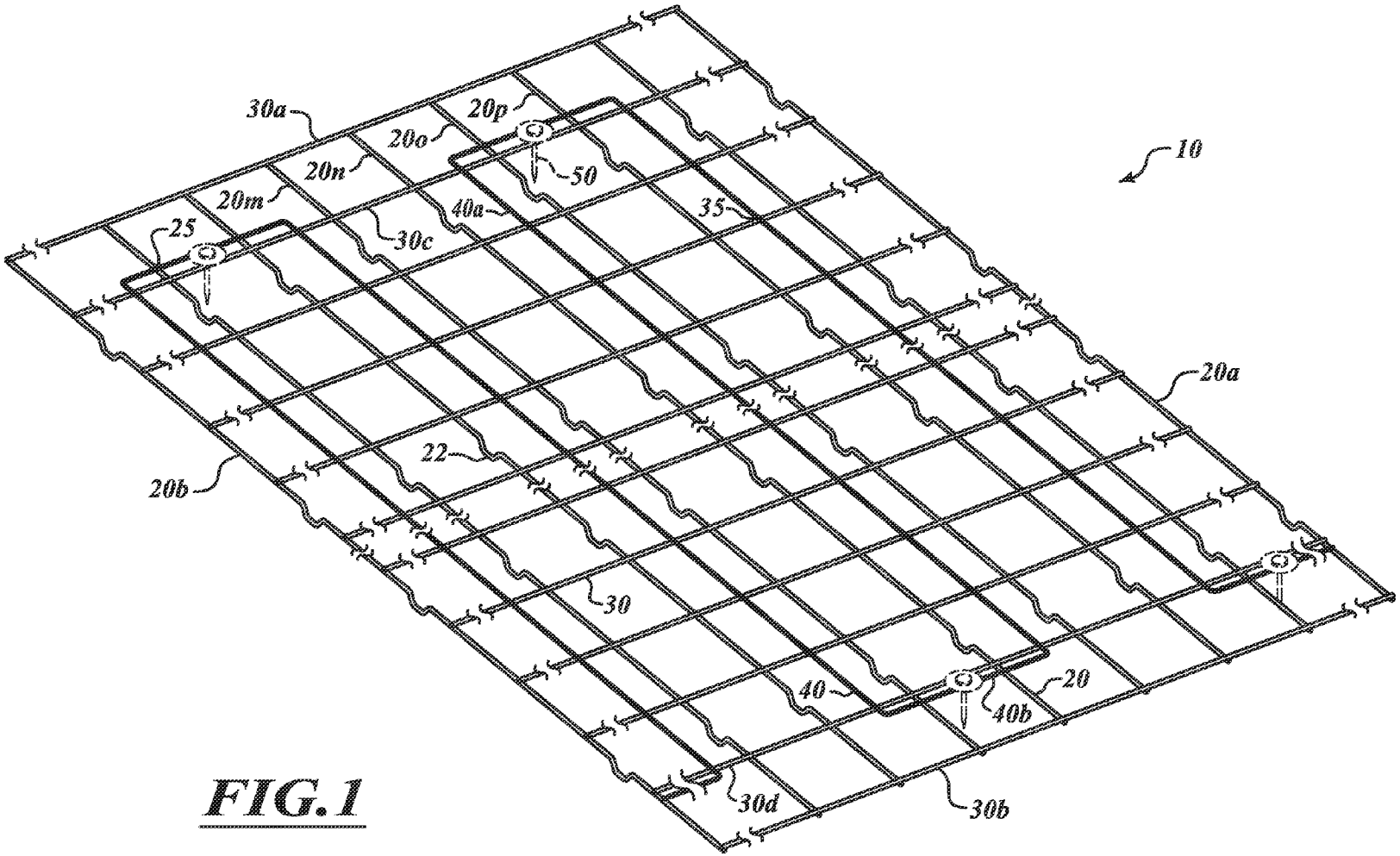
FIG. 1 is a top isometric view of a lath according to an embodiment.

FIG. 1 shows a lath 10, according to an embodiment. The lath 10 is comprised of a plurality of furring strand elongate members 20, a plurality of transverse elongate members 30 and a stabilization elongate member 40. FIG. 1 is not to be interpreted as limiting the quantity of furring strand elongate members 20 or the quantity of transverse elongate members 30.

Figure 4:
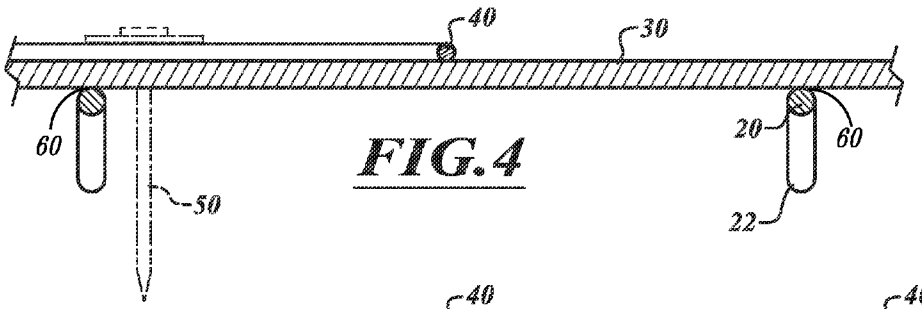

An elongate member may be made of wire, for example single strand metal wire of a sufficiently small gauge. In some implementations the stabilization elongate member 40 may be of the same diameter (e.g., gauge) as the furring strand elongate members 20. In other implementations, the diameter of the stabilization elongate member 40 may be less than a corresponding diameter of the furring strand elongate members 20, as shown in FIG. 4. In still other implementations, the diameter of the stabilization elongate member 40 may be greater than a corresponding diameter of the furring strand elongate members 20 (not shown).

Figure 5:
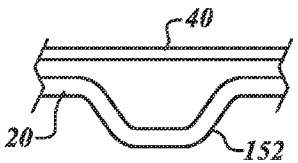
FIG. 5 is a front isometric view of a "U" shaped projection of the lath of FIG. 1.
Figure 6:
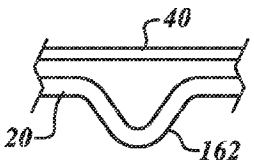
FIG. 6 is a front isometric view of a "V" shaped projection of the lath of FIG. 1.

A furring strand elongate member 20 includes a furring offset, step or spacer 22 which is a discontinuity such as a bend or step that spaces the predominate portion of the furring strand elongate member 20 from a wall, surface, substrate or other generally planar surface in use. For clarity of illustration, only one furring bend 22 is called out in FIG. 1. Furring strand elongate members 20 are substantially straight except for the furring bends 22. A furring bend 22 may be "U" shaped projections 152, as shown in FIG. 5, or "V" shaped projections 162, as shown in FIG. 6. Of course, any applicable shape will suffice such as channel shaped with a flat bottom section. A flat bottom may advantageously enhance stability. FIG. 1 is not to be interpreted as limiting the size, quantity or placement of furring bends 22 on a furring strand elongate member 20.

The furring strand elongate members 20 may be at least approximately parallel to and spaced apart from one another. The spacing between the furring strand elongate members 20 may be based on the cladding to be applied. The transverse elongate members 30 may also be at least approximately parallel to and spaced apart from one another. Again, the spacing between the transverse elongate members 30 may be based on the cladding to be applied. Transverse elongate members 30 may be substantially straight.

The transverse elongate members 30 may be at least approximately perpendicular to the furring strand elongate members 20. The transverse elongate members 30 may be substantially straight. Each transverse elongate member 30 is physically joined to at least one of the furring strand elongate members 20. For example, each of the transverse elongate members 30 may be welded to a number of the furring strand elongate members 20 at points of locations at which the transverse elongate members 30 and the furring strand elongate members 20 intersect or cross. The physical joining may be at a location along the at least one furring strand elongate member 20 that is an intersection point 60 that does not overlap with any of the at least one furring bends 22 of the respective at least one furring strand elongate member 30. In other words, under an embodiment, transverse elongate members 30 are not physically joined to the furring bends 22 of the furring strand elongate members 20. Thus, the transverse elongate members 30 may all lie in a single plane. The predominate portions of the furring strand elongate members 20 may lie in the same plane as the transverse elongate members 30.

The stabilization elongate member 40 may be one contiguous wire that follows a serpentine path in relation to the transverse elongate members 30 and the furring strand elongate members 20. In other words, the stabilization elongate member 40 may travel back and forth along a path of the lath 10. At least a portion of the stabilization elongate member 40 may extend between a first outermost one 30*a* of the transverse elongate members 30 and a second outermost one 30*b* of the transverse elongate members 30 and may extend between a first outermost one 20*a* of the furring strand elongate members 20 and a second outermost one 20*b* of the furring strand elongate members 20.

In some implementations, ends of the stabilization elongate member 40 do not extend beyond the first outermost one 30*a* or the second outermost one 30*b* of the transverse elongate members 30. As illustrated in FIG. 1, the respective ends of the stabilization elongate member 40 may coterminate with the first outermost one 20*a* of the furring strand elongate members 20 and the second outermost one 20*b* of the furring strand elongate members 20. In another implementation, the respective ends of the stabilization elongate member 40 extend beyond one or both of the first outermost one 20*a* of the furring strand elongate members 20 and the second outermost one 20*b* of the furring strand elongate members 20. In another implementation, the respective ends of the stabilization elongate member 40 do not extend beyond the first outermost one 20*a* of the furring strand elongate members 20 and the second outermost one 20*b* of the furring strand elongate members 20.

Figure 2:
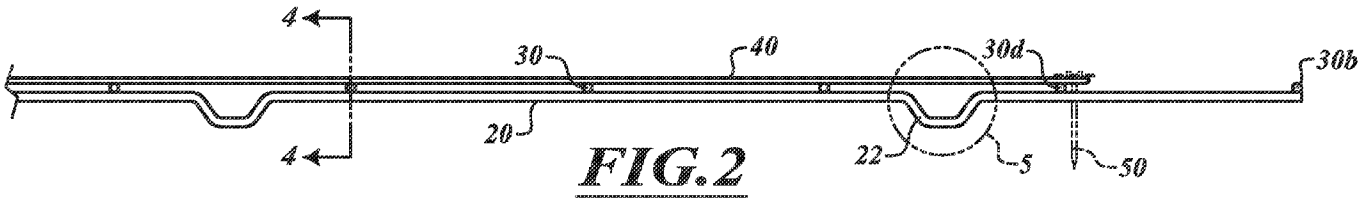
FIG. 2 is a front isometric view of the lath of FIG. 1.
Figure 3:
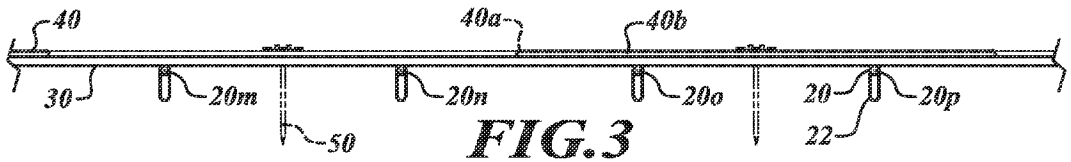
FIG. 3 is a right side isometric view of the lath of FIG. 1.

As shown in FIGS. 2 and 3, the transverse elongate members 30 and the stabilization elongate member 40 may substantially lie in a single plane. As also shown in FIG. 3, the furring bends 22 may extend substantially perpendicularly to the single plane.

The stabilization elongate member 40 may have a first plurality of straight portions 40*a* that are at least approximately parallel to the furring strand elongate members 20 and a second plurality of portions 40*b* that are at least approximately parallel to the transverse elongate members 30. The stabilization elongate member 40 may be physically joined (e.g., welded) to at least one of the transverse elongate members 30 at a respective intersection point 35 and/or at least one of the furring strand elongate members 20 at a respective intersection point 25.

A weld may physically join or couple one elongate member to another elongate member. In an embodiment, each intersection point 35 and 25 represents a physical joining or coupling. However, some intersection points 35 and 25 may not be physically joined, attached or coupled. Furthermore, the furring strand elongate members 20 may be joined with some or all of the transverse elongate members 30 via at least one respective weld. The stabilization elongate member 40 may also be joined or coupled to at least some of the furring strand elongated members and at least some of the stabilization elongated members via at least one respective weld. Although FIG. 1 shows the transverse elongate members 30 positioned between the furring strand elongate members 20 and the stabilization elongate member 40, another embodiment positions the furring strand elongate members 20 between the transverse elongate members 30 and the stabilization elongate member 40.

A fastener 50 may attach the lath 10 to a substrate (not shown). A fastener 50 may be any device that attaches a lath to a substrate, such as a nail, screw, bolt, staple, pin or any similar lath fastening device. Of course, there may be additional fasteners (not shown) as required by codes and regulations, or by chosen work practice.

In some implementations, a first number of the second plurality of straight portions 40*b* of the stabilization elongate member 40 may be spaced from a first inward transverse elongate member 30*c* by a distance sized to receive a fastener 50 therebetween. The distance is preferably between one eighth of an inch and one quarter of an inch, though the distance may vary depending on the size of the fastener 50. The fastener 50 may be placed anywhere in the spacing, but is preferably placed in the midpoint of the spacing. A second number of the second plurality of straight portions 40*b* of the stabilization elongate member may be spaced from a second inward traverse elongate member 30*d* by a distance sized to receive a fastener 50 therebetween. The distance is, again, preferably between one eighth of an inch and one quarter of an inch, though the distance may vary depending on the size of the fastener 50. Again, the fastener 50 may be placed anywhere in the spacing, but is preferably placed in the midpoint of the spacing. The first inward transverse elongated member 30*c* may be the most immediately adjacent transverse member to the first outermost transverse elongated member 30*a* and the second inward transverse elongated member 30*d* may be the most immediately adjacent transverse member to the second outermost transverse elongated member 30*b*.

FIG. 1 shows that for each of a number of pairs of the furring strand elongate members 20, there is a respective one of the first plurality of straight portions 40*a* of the stabilization elongate member extending between one 20*n* of the furring strand elongate members 20 of the pair 20*m*-20*n* and one 20*o* of the furring strand elongated members of a next successively adjacent pair 20*o*-20*p* of the furring strand elongated members.

FIG. 2 shows the lath 10 of FIG. 1 with the stabilization elongate member 40 visible above, and the furring strand elongate member 20, with furring bends 22, clearly visible. A plurality of transverse elongate members 30 is visible between the stabilization elongate member 40 and the furring strand elongate member 20. Of course, alternative embodiments may have different relative positioning of the respective elongate members.

FIG. 3 shows the lath 10 of FIG. 1, with the stabilization elongate member 40 visible above, and the furring strand elongate members 20, with furring bends 22, clearly visible. A transverse elongate member 30 is visible between the stabilization elongate member 40 and the plurality of furring strand elongate members 20. Of course, alternative embodiments may have different relative positioning of the respective elongate members.

Figure 7:
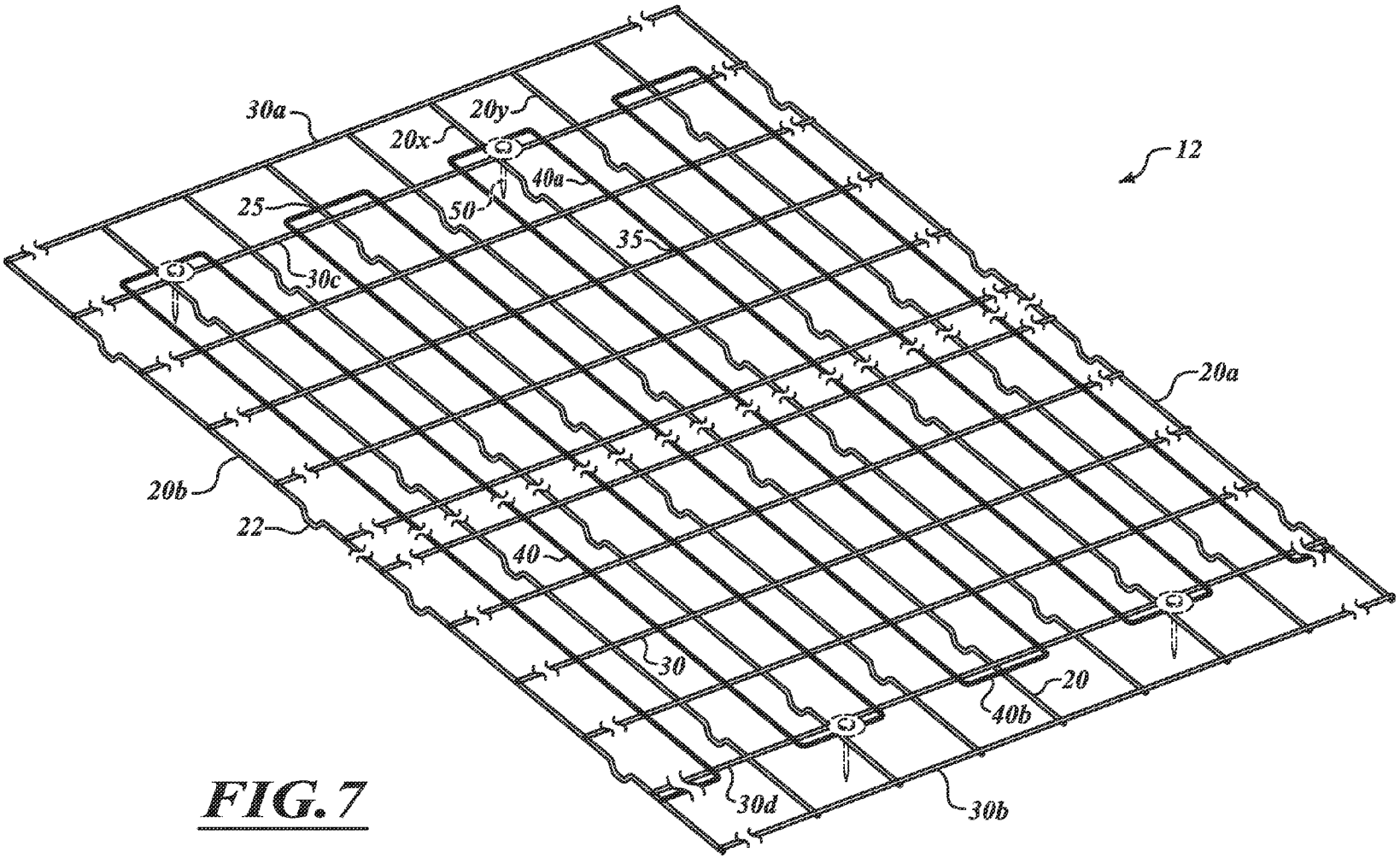
FIG. 7 is a top isometric view of a lath according to an embodiment.
Figure 8:
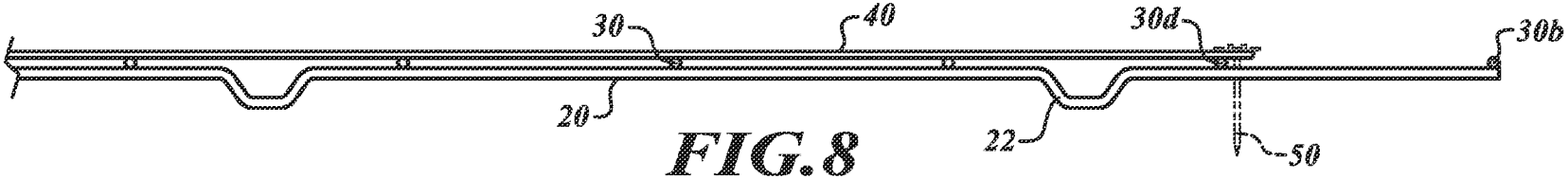
FIG. 8 is a front isometric view of the lath of FIG. 4.
Figure 9:
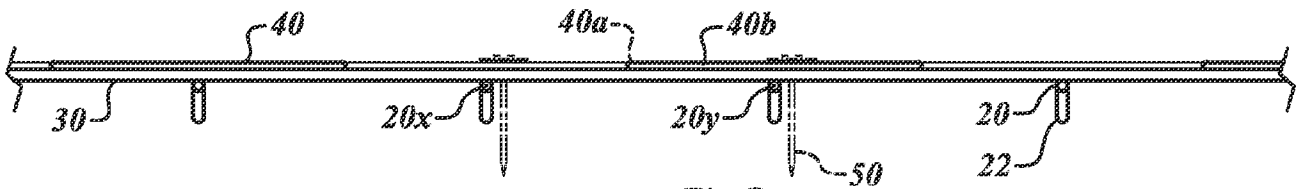
FIG. 9 is a right side isometric view of the lath of FIG. 4.

FIGS. 7-9 shows a lath 12 according to an embodiment. The lath 12 of FIGS. 7-9 is similar to the lath 10 of FIG. 1 with the primary difference being that for each of a number of successive pairs 20*x*-20*y* of furring strand elongate members 20, there is a respective one of the first plurality of straight portions 40*a* of the stabilization elongate member 40 extending therebetween.

Although FIGS. 1 through 3 and 7 through 9 show the respective elongate members being relatively equal in diameter or gauge, as discussed above and shown in FIG. 4, the dimensions of the respective elongate members may vary from each other. For example, the stabilization elongate member 40 could have a smaller or larger diameter than the furring strand elongate members 20 or the transverse elongate members 30. For further example, the cross-sectional views of an elongate member may illustrate a perimeter with any applicable shape, such as a circle, an oval, a square or a rectangle.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other laths and methods of producing a lath, not necessarily the exemplary laths and methods generally described above. For example, the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A lath, comprising:

a plurality of furring strand elongate members, the furring strand elongate members at least approximately parallel to and spaced apart from one another, each of the furring strand elongate members have at least one furring bend;

a plurality of transverse elongate members, each of the transverse elongate members affixed to at least one of the furring strand elongate members at a location along the at least one furring strand elongate member that does not overlap with any of the furring bends of the respective at least one furring strand elongate member, the transverse elongate members at least approximately parallel to and spaced apart from one another, and the transverse elongate members at least approximately perpendicular to the furring strand elongate members; and a stabilization elongate member that has a serpentine path and that at least a portion of which extends between a first outermost transverse elongate member and a second outermost transverse elongate member and between a first outermost furring strand elongate member and a second outermost furring strand elongate member, the stabilization elongate member having a first plurality of straight portions that are at least approximately parallel to the furring strand elongate members and a second plurality of portions that are at least approximately parallel to the transverse elongate members, the stabilization elongate member affixed to at least one of the transverse elongate members, at least one of the furring strand elongate members, or a combination of at least one transverse elongate member and at least one furring strand elongate member.

2. The lath of claim 1 wherein the stabilization elongate member does not extend beyond the first outermost transverse elongate member or the second outermost transverse elongate member.

3. The lath of claim 2 wherein at least one of the second plurality of straight portions of the stabilization elongate member is spaced from a first inward transverse elongate member by a distance sized to receive a fastener therebetween and at least one of the second plurality of straight portions of the stabilization elongate member is spaced from a second inward traverse elongate member by a distance sized to receive a fastener therebetween, the first inward transverse elongate member being the most immediately adjacent transverse elongate member to the first outermost transverse elongate member and the second inward transverse elongate member being the most immediately adjacent transverse elongate member to the second outermost transverse elongate member.

4. The lath of claim 1 wherein the stabilization elongate member extends beyond the first outermost furring strand elongate member and the second outermost furring strand elongate member.

5. The lath of claim 1 wherein the transverse elongate members and the stabilization elongate member substantially lie in a single plane.

6. The lath of claim 5 wherein the furring bends extend substantially perpendicularly to the single plane.

7. The lath of claim 1 wherein each of the plurality of furring strand elongate members is substantially straight except for the at least one furring bend, and the at least one furring bend includes at least one of a U-shaped projection, a V-shaped projection, or a flat-bottom-channel projection in the substantially straight furring strand elongate members.

8. The lath of claim 1 wherein, for each of a number of successive pairs of furring strand elongate members, there is a respective one of the first plurality of straight portions of the stabilization elongate member extending therebetween.

9. The lath of claim 1 wherein for each of a number of pairs of the furring strand elongate members, there is a respective one of the first plurality of straight portions of the stabilization elongate member extending between one of the furring strand elongate members of the pair and one of the furring strand elongated members of a next successively adjacent pair of the furring strand elongated members.

10. The lath of claim 1 wherein each elongate member comprises wire and a diameter of the stabilization elongate member is less than a corresponding diameter of the furring strand elongate members.

11. The lath of claim 1 wherein the stabilization elongate member is affixed to at least one of the plurality of furring strand elongated members or at least one of the plurality of transverse elongated members or a combination of at least one of the plurality of furring strand elongated members and at least one of the plurality of transverse elongated members via at least one weld.

12. A lath, comprising:

a plurality of furring strand elongate members, each of the plurality of furring strand elongate members at least approximately parallel to and spaced apart from one another, each of the furring strand elongate members have at least one furring bend;

a plurality of transverse elongate members at least approximately parallel and spaced apart from one another in a first plane, each of the plurality of transverse elongate members affixed approximately perpendicular to at least one of the furring strand elongate members at a location along the at least one furring strand elongate member that does not overlap with any of the at least one furring bends of the respective at least one furring strand elongate member; and a stabilization elongate member that has a serpentine path and that has a first plurality of straight portions in a second plane that is parallel to the first plane, the first plurality of straight portions at least approximately parallel to the furring strand elongate members and a second plurality of portions in the second plane that are at least approximately parallel to the transverse elongate members, the stabilization elongate member affixed to at least one of the transverse elongate members, at least one of the furring strand elongate members, or a combination of at least one transverse elongate member and at least one furring strand elongate member.

13. A method of producing a lath, comprising:

arranging a plurality of furring strand elongate members, the furring strand elongate members at least approximately parallel to and spaced apart from one another, each of the furring strand elongate members have at least one furring bend;

arranging a plurality of transverse elongate members, the transverse elongate members at least approximately parallel to and spaced apart from one another, and the transverse elongate members at least approximately perpendicular to the furring strand elongate members;

arranging a stabilization elongate member to have a serpentine path such that at least a portion of which extends between a first outermost transverse elongate member and a second outermost transverse elongate member and between a first outermost furring strand elongate member and a second outermost furring strand elongate member, arranging the stabilization elongate member to have a first plurality of straight portions that are at least approximately parallel to the furring strand elongate members and a second plurality of portions that are at least approximately parallel to the transverse elongate members;

affixing each of the transverse elongate members to at least one of the furring strand elongate members at a location along the furring strand elongate members that does not overlap with any of the at least one furring bends of the respective furring strand elongate member; and affixing the stabilization elongate member to at least one of the transverse elongate members, at least one of the furring strand elongate members, or at least one of the transverse elongate members and at least one of the furring strand elongate members.

14. The method of claim 13 wherein the arranging of the stabilization elongate member comprises arranging the stabilization elongate member to not extend beyond the first outermost transverse elongate member or the second outermost transverse elongate member.

15. The method of claim 13 wherein the arranging of the stabilization elongate member comprises spacing at least one of the second plurality of straight portions of the stabilization elongate member from a first inward transverse elongate member by a distance sized to receive a fastener therebetween and spacing at least one of the second plurality of straight portions of the stabilization elongate member from a second inward traverse elongate member by a distance sized to receive a fastener therebetween, the first inward transverse elongate member being the most immediately adjacent transverse elongate member to the first outermost transverse elongate member and the second inward transverse elongate member being the most immediately adjacent transverse elongate member to the second outermost transverse elongate member.

16. The lath of claim 13 wherein the arranging of the stabilization elongate member comprises arranging the stabilization elongate member to extend beyond the first outermost furring strand elongate member and the second outermost furring strand elongate member.

17. The method of claim 13 wherein the arranging of the plurality of transverse elongate members and the arranging of the stabilization elongate member comprises arranging the plurality of transverse elongate members and arranging the stabilization elongate member to lie in a single plane.

18. The method of claim 17 wherein the arranging of the plurality of furring strand elongate members comprises arranging the furring bends of the plurality of furring strand elongate members to extend substantially perpendicularly to the single plane.

19. The method of claim 13 further comprising:

forming each of the plurality of furring strand elongate members to be substantially straight except for the at least one furring bend; and forming the at least one furring bend to be at least one of: a U-shaped projection, a V-shaped projection or a flat-bottom-channel projection in the substantially straight furring strand elongate members.

20. The method of claim 13 wherein the arranging of the stabilization elongate member comprises, for each of a number of successive pairs of furring strand elongate members, arranging a respective one of the first plurality of straight portions of the stabilization elongate member to extend therebetween.

21. The method of claim 13 wherein the arranging of the stabilization elongate member comprises, for each of a number of pairs of the furring strand elongate members, arranging a respective one of the first plurality of straight portions of the stabilization elongate member to extend between one of the furring strand elongate members of the pair and one of the furring strand elongated members of a next successively adjacent pair of the furring strand elongated members.

22. The method of claim 13 further comprising:

forming each of the plurality of transverse elongate members, each of the plurality of furring strand elongate members, and the stabilization elongate member to comprise wire; and forming a diameter of the stabilization elongate member to be less than a corresponding diameter of each of the plurality of furring strand elongate members.

23. The method of claim 13 wherein affixing the stabilization elongate member to the number of at least one of the plurality of transverse elongate members, at least one of the plurality of furring strand elongate members, or at least one of the plurality of transverse elongate members and at least one of the plurality of furring strand elongate members is via at least one weld.

* * * * *